US006648609B2

(12) United States Patent
Berger et al.

(10) Patent No.: US 6,648,609 B2
(45) Date of Patent: Nov. 18, 2003

(54) PUMP AS A PRESSURE SOURCE FOR SUPERCRITICAL FLUID CHROMATOGRAPHY INVOLVING PRESSURE REGULATORS AND A PRECISION ORIFICE

(75) Inventors: Terry A. Berger, Newark, DE (US); Kimber D. Fogelman, Hockessin, DE (US); Kenneth Klein, Newark, DE (US); L. Thompson Staats, III, Lincoln University, PA (US); Mark Nickerson, Landenburg, PA (US); Paul F. Bente, III, Landenburg, PA (US)

(73) Assignee: Berger Instruments, Inc., Newark, DE (US)

( * ) Notice: Subject to any disclaimer, the term of this patent is extended or adjusted under 35 U.S.C. 154(b) by 0 days.

(21) Appl. No.: 10/117,984

(22) Filed: Apr. 5, 2002

(65) Prior Publication Data

US 2003/0190237 A1 Oct. 9, 2003

(51) Int. Cl.[7] ..... F04B 49/08

(52) U.S. Cl. ..... 417/297; 417/292; 417/248; 137/613; 137/614.2; 137/512; 251/118; 210/198.2; 73/23.42; 73/61.56

(58) Field of Search ..... 417/292, 297, 417/248; 137/613, 614.2, 512; 251/118; 210/198.2; 73/23.41, 23.42, 61.55, 61.56

(56) References Cited

U.S. PATENT DOCUMENTS 4,042,326 A * 8/1977 Kallos ..... 436/126
4,095,472 A * 6/1978 Mowery, Jr. ..... 73/61.56
4,690,689 A * 9/1987 Malcosky et al. ..... 48/174
4,990,076 A * 2/1991 Lynch et al. ..... 422/112
5,094,741 A * 3/1992 Frank et al. ..... 210/198.2
5,133,859 A 7/1992 Frank et al.
5,151,250 A * 9/1992 Conrad ..... 422/2
5,240,603 A 8/1993 Frank et al.
5,378,229 A * 1/1995 Layer et al. ..... 604/31
5,431,545 A * 7/1995 Knight et al. ..... 417/248
5,797,719 A 8/1998 James et al.
5,888,050 A 3/1999 Fitzgerald et al.
6,309,541 B1 * 10/2001 Maiefski et al. ..... 210/198.2
6,413,428 B1 * 7/2002 Berger et al. ..... 210/634
6,503,396 B2 * 1/2003 Kim et al. ..... 210/634

* cited by examiner

*Primary Examiner*—Charles G. Freay
*Assistant Examiner*—Emmanuel Sayre
(74) *Attorney, Agent, or Firm*—ZITO tlp; Joseph J. Zito

(57) ABSTRACT

The invention is a device and method in a high-pressure chromatography system, such as a supercritical fluid chromatography (SFC) system, that uses a pump as a pressure source for precision pumping of a compressible fluid. The preferred exemplary embodiment comprises a pressure regulation assembly installed downstream from a compressible fluid pump but prior to combining the compressible flow with a relatively incompressible modifier flow stream. The present invention allows the replacement of an high-grade SFC pump in the compressible fluid flow stream with an inexpensive and imprecise pump. The imprecise pump becomes capable of moving the compressible fluid flow stream in a precise flow rate and pattern. The assembly dampens the damaging effects of an imprecise pump, such as large pressure oscillations caused by flow ripples and noisy pressure signals that do not meet precise SFC pumping requirements.

11 Claims, 6 Drawing Sheets

PUMP AS A PRESSURE SOURCE FOR SUPERCRITICAL FLUID CHROMATOGRAPHY INVOLVING PRESSURE REGULATORS AND A PRECISION ORIFICE

FIELD OF THE INVENTION

The invention relates to a device and method for using a pump as a pressure source, instead of a flow source, in a high-pressure chromatography system, such as supercritical fluid chromatography.

BACKGROUND OF THE INVENTION

An alternative separation technology called supercritical fluid chromatography (SFC) has advanced over the past decade. SFC uses highly compressible mobile phases, which typically employ carbon dioxide (CO2) as a principle component. In addition to CO2, the mobile phase frequently contains an organic solvent modifier, which adjusts the polarity of the mobile phase for optimum chromatographic performance. Since different components of a sample may require different levels of organic modifier to elute rapidly, a common technique is to continuously vary the mobile phase composition by linearly increasing the organic modifier content. This technique is called gradient elution.

SFC has been proven to have superior speed and resolving power compared to traditional HPLC for analytical applications. This results from the dramatically improved diffusion rates of solutes in SFCmobile phases compared to HPLC mobile phases. Separations have been accomplished as much as an order of magnitude faster using SFC instruments compared to HPLC instruments using the same chromatographic column. A key factor to optimizing SFC separations is the ability to independently control flow, density and composition of the mobile phase over the course of the separation. SFC instruments used with gradient elution also reequillibrate much more rapidly than corresponding HPLC systems. As a result, they are ready for processing the next sample after a shorter period of time. A common gradient range for gradient SFC methods might occur in the range of 2% to 60% composition of the organic modifier.

It is worth noting that SFC instruments, while designed to operate in regions of temperature and pressure above the critical point of CO2, are typically not restricted from operation well below the critical point. In this lower region, especially when organic modifiers are used, chromatographic behavior remains superior to traditional HPLC and often cannot be distinguished from true supercritical operation.

A second analytical purification technique similar to SFC is supercritical fluid extraction (SFE). Generally, in this technique, the goal is to separate one or more components of interest from a solid matrix. SFE is a bulk separation technique, which does not necessarily attempt to separate individually the components, extracted from the solid matrix. Typically, a secondary chromatographic step is required to determine individual components. Nevertheless, SFE shares the common goal with prep SFC of collecting and recovering dissolved components of interest from supercritical flow stream. As a result, a collection device suitable for preparative SFC should also be suitable for SFE techniques.

Packed column SFC uses multiple, high pressure, reciprocating pumps, operated as flow sources, and independent control of system pressure through the use of electronic back pressure regulators. Such a configuration allows accurate reproducible composition programming, while retaining flow, pressure, and temperature control. Reciprocating pumps are generally used in supercritical fluid chromatography systems that use a packed chromatography column for elution of sample solute. Reciprocating pumps can deliver an unlimited volume of mobile phase with continuous flow, typically pumping two separate flow streams of a compressible supercritical fluid and incompressible modifier fluid that are combined downstream of the pumping stages to form the mobile phase. Reciprocating pumps for SFC can be modified to have gradient elution operational capabilities.

A great deal of subtlety is required to pump fluids in SFC. Not any reciprocating pump can be used with a pump head chiller to make an SFC pump. While most HPLC pumps can be set to compensate for the compressibility, compensation is too small to deal with the fluids most often used in SFC. To attempt to minimize the compressibility range required, the pump is usually chilled to insure the fluid is a liquid, far from its critical temperature. Chilled fluids are dense but are still much more compressible than the normal liquids used in HPLC. To control flow accurately, the pump must have a larger than expected compressibility compensation range. Further, since the compressibility changes with pressure and temperature, the pump must be capable of dynamically changing compressibility compensation. Inadequate compensation results in errors in both the flow rate and the composition of modified fluids.

Without correct compressibility compensation, the pump either under- or over-compresses the fluid causing characteristic ripples in flow and pressure. Either under- or over-compression results in periodic variation in both pressure and flow with the characteristic frequency of the pump (ml/min divided by pump stroke volume in ml). The result is noisy baselines and irreproducibility. To compensate for this, the more expensive and better liquid chromatography pumps have compressibility adjustments to account for differences in fluid characteristics.

SFC systems in the prior art have used modified HPLC high-pressure pumps operated as a flow source. One pump delivered compressible fluids, while the other was usually used to pump modifiers. A mechanical back pressure regulator controlled downstream pressure. The pumps used a single compressibility compensation, regardless of the fluids used. The compressible fluid and the pump head were cooled near freezing. The delivery of carbon dioxide varied with pressure and flow rate. The second pump delivered accurate flows of modifier regardless of pressure and flow. At different pressures and flows, the combined pumps delivered different compositions although the instrument setpoints remained constant. Pumping compressible fluids, such as CO2, at high pressures in SFC systems while accurately controlling the flow, is much more difficult than that for a liquid chromatography system. SFC systems use two pumps to deliver fluids to the mobile phase flow stream, and each pump usually adds pressure and flow ripples and variances that cause baseline noise. The two pumps also operate at different frequencies, different flow rates, and require separate compressibility compensations, further adding to the complexity of flow operations.

Methods in the prior art calculate ideal compressibility based on measured temperature and pressure using a sophisticated equation of state. The method then uses dithering around the setpoint to see if a superior empirical value can be found. This approach is described in U.S. Pat. No. 5,108,264, Method and Apparatus for Real Time Compensation of Fluid Compressibility in High Pressure Reciprocating Pumps, and U.S. Pat. No. 4,883,409, Pumping Apparatus for Delivering Liquid at High Pressure. Other prior art methods move the pump head until the pressure in the refilling cylinder is nearly the same as the pressure in the delivering pump head. One method in U.S. Pat. No. 5,108,264 Method and Apparatus for Real Time Compensation of Fluid Compressibility in High Pressure Reciprocating Pumps, adjusts the pumping speed of a reciprocating pump by delivering the pumping fluid at high pressure and desired flow rate to overcome flow fluctuations. These are completely empirical forms of compressibility compensation. The prior art methods require control of the fluid temperature and are somewhat limited since they does not completely compensate for the compressibility. The compensation stops several hundred psi from the column inlet pressure.

In SFC, it is common to use very long columns with large pressure drops to generate very high efficiency compared to HPLC. The use of long columns resulted from a change in control philosophy. Earlier in SFC technology, the pump was used as the pressure controller. the column outlet pressure was not controlled. Long columns produced large pressure drops, and at modest inlet pressures, the outlet pressure could drop to the point where several sub-critical phases could exist. The co-existence of several phases destroys chromatographic separations and efficiency. Controlling the column outlet pressure, the pump becomes a flow source, not a pressure source. Consequently, the point in the system with the worst solvent strength becomes the control point. All other positions in the system have greater solvent strength. By controlling this point, problems associated with phase separations or solubility problems at uncontrolled outlet pressures are eliminated.

The compressibility of the pumping fluid directly effects volumetric flow rate and mass flow rate. These effects are much more noticeable when using compressible fluids such as carbon dioxide in SFC rather than fluids in liquid chromatography. The assumption of a constant compressibility leads to optimal minimization of fluid fluctuation at only one point of the pressure/temperature characteristic, but at other pressures and temperatures, flow fluctuations occur in the system.

The flow rate should be kept as constant as possible through the separation column. If the flow rate fluctuates, variations in the retention time of the injected sample would occur such that the areas of the chromatographic peaks produced by a detector connected to the outlet of the column would vary. Since the peak areas are representative for the concentration of the chromatographically separated sample substance, fluctuations in the flow rate would impair the accuracy and the reproducibility of quantitative measurements. At high pressures, compressibility of solvents is very noticeable and failure to account for compressibility causes technical errors in analyses and separation in SFC.

The type of pump control philosophy in an SFC system affects resolution in pressure programming. A pressure control pump with a fixed restrictor results in broadened peaks and higher background noise through a packed column. Efficiency degrades as pressure increases. A flow control pump with a back-pressure regulator has better resolution results through a packed column and steady background. Efficiency remains constant with increasing pressure. With independent flow control, the chromatographic linear velocity is dictated by the pump, and remains near optimum, throughout a run. The elution strength is controlled separately, using a back-pressure regulator. With pressure controlled pumps, a fixed restrictor passively limits flow. The linear velocity increases excessively during a run, thereby degrading the chromatography.

Therefore, a need exists for a system that uses a pump as a pressure source in SFC without degrading the chromatography results.

SUMMARY

The exemplary embodiment is useful in a high-pressure chromatography system, such as a supercritical fluid chromatography (SFC) system, for using a pump as a pressure source for precision pumping of a compressible fluid. The preferred exemplary embodiment comprises a pressure regulation assembly installed downstream from a compressible fluid pump but prior to combining the compressible flow with a relatively incompressible modifier flow stream that allows the replacement of an high-grade SFC punp in the compressible fluid flow stream with an inexpensive and imprecise pump. The imprecise pump becomes capable of moving the compressible fluid flow stream in a precise flow rate and pattern. The assembly dampens the damaging effects of an imprecise pump, such as large pressure oscillations caused by flow ripples and noisy pressure signals that do not meet precise SFC pumping requirements.

The invention regulates the outlet pressure from a pump using a system of pressure regulators and a restriction in the flow stream. To regulate outlet pressure directly downstream of a pump, a forward-pressure regulator (FPR) is installed in the flow line. Downstream of the forward-pressure regulator the flow is restricted with a precision orifice. The orifice can be any precision orifice, such as a jewel having a laser-drilled hole or precision tubing. Downstream of the orifice is a back-pressure regulator (BPR). The series of an FPR-orifice-BPR is designed to control the pressure drop across the orifice, which dampens out oscillation from noisy pressure signals caused by large ripples in the flow leaving the pump. An additional embodiment uses a differential pressure transducer around the orifice with a servo control system to further regulate the change in pressure across the orifice. The combination allows the replacement of an expensive, SFC-grade pump having compressibility compensation with an inexpensive, imprecise pump such as an air-driven pump.

The system can be multiplexed in parallel flow streams, thereby creating significantly greater volumetric capacity in SFC and a greater number of inexpensive compressible fluid flow channels. The parallel streams can all draw from a single source of compressible fluid, thereby reducing the costs of additional pumps. Some alternatives to the multiplexed system uses the single compressible fluid pump to raise pressure in the flow line from the compressible fluid source combined with additional second stage booster pumps in each individual SFC flow stream. Another system replaces multiple modifier solvent pumps for each channel with a single, multi-piston pump having outlets for each individual channel.

BRIEF DESCRIPTION OF THE DRAWINGS

For a better understanding of the nature of the present invention, reference is had to the following figures and detailed description, wherein like elements are accorded like reference numerals, and wherein.

DETAILED DESCRIPTION OF PREFERRED EMBODIMENTS

There is described herein a preferred embodiment of the present invention for a device and method in a high-pressure chromatography system, such as supercritical fluid chromatography (SFC), that uses a pump as a pressure source for precision pumping of a compressible fluid. As further described herein, the preferred exemplary embodiment comprises a pressure regulation assembly installed downstream from a compressible fluid pump but prior to combining the compressible flow with a relatively incompressible flow stream. The present invention provides for the replacement of an expensive SFC-grade pump for compressible fluids having dynamic compressibility compensation, with a less-expensive and imprecise pump to move a compressible fluid flow stream in a precise flow rate and pressure signal. The assembly dampens the damaging effects of a low-grade pump, such as large pressure and flow oscillations caused by flow ripples and noisy pressure signals that do not meet precise SFC pumping requirements.

Figure 1:
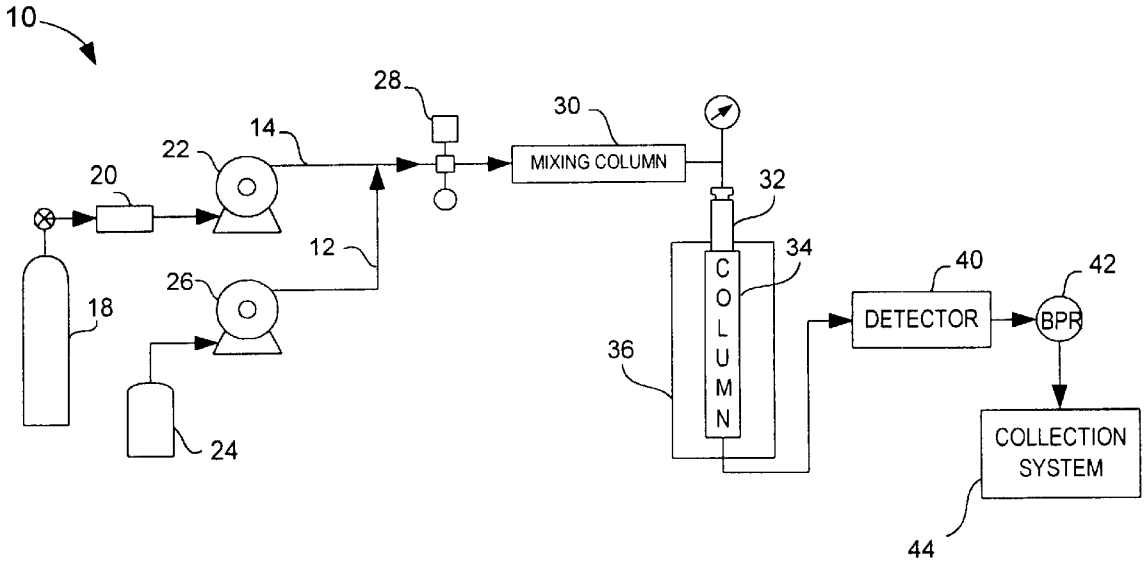
FIGURE 1 PRIOR ART
FIG. 1 is a flow diagram of an supercritical fluid chromatography system.

Components of an SFC system 10 are illustrated in the schematic of FIG. 1. The system 10 comprises two independent flow streams 12, 14 combining to form the mobile phase flow stream. In a typical SFC pumping assembly, a compressible fluid, such as carbon dioxide (CO2), is pumped under pressure to use as a supercritical solvating component of a mobile phase flow stream. Tank 18 supplies CO2 under pressure that is cooled by chiller 20. Due to precise pumping requirements, SFC systems commonly use an SFC-grade reciprocating piston pump having dynamic compressibility compensation.

A second independent flow stream in the SFC system provides modifier solvent, which is typically methanol but can be a number of equivalent solvents suitable for use in SFC. Modifier is supplied from a supply tank 24 feeding a second high-grade pump for relatively incompressible fluids 26. Flow is combined into one mobile phase flow stream prior to entering mixing column 30. The combined mobile phase is pumped at a controlled mass-flow rate from the mixing column 30 through transfer tubing to a fixed-loop injector 32 where a sample is injected into the flow stream.

The flow stream, containing sample solutes, then enters a chromatography column 34. Column 34 contains stationary phase that elutes a sample into its individual constituents for identification and analysis. Temperature of the column 34 is controlled by an oven 36. The elution mixture leaving column 34 passes from the column outlet into detector 40. Detector 40 can vary depending upon the application, but common detectors are ultraviolet, flame ionization (with an injector- or post-column split), or GC/MS. After analysis through the detector 40, the mobile phase flow stream passes through a back-pressure regulator (BPR) 42, which leads to a downstream sample fraction collection system 44.

For precision SFC pumping, pump 22 must have some type of compressibility compensation, otherwise pressure ripples and flow fluctuations will result in noisy baselines and irreproducibility of flow rates and pressures. Compressibility compensation accounts for under or over-compensation in the piston and differences in fluid compressibilities. High-pressure SFC pumps used as flow sources have an extended compressibility range and the ability to dynamically change the compression compensation. The compressibility of the pumping fluid directly effects volumetric flow rate and mass flow rate. These effects are much more noticeable when using compressible fluids, such as CO2, in SFC systems than fluids in liquid chromatography. The assumption of a constant compressibility leads to optimal minimization of fluid fluctuation at only one point the pressure/temperature characteristic, but at other pressures and temperatures, flow fluctuations occur in the system. If the mobile phase flow rate is not kept as constant as possible through the column, variation in the retention time of the injected sample to the outlet of the columns would vary. Since the peak areas are representative of the concentration of the separated sample solutes, fluctuations in the flow rate would impair the accuracy and the reproducibility of quantitative measurements. At high pressures, compressibility of solvents is very noticeable and failure to account for compressibility causes technical errors in analyses and separation in SFC.

Figure 2:
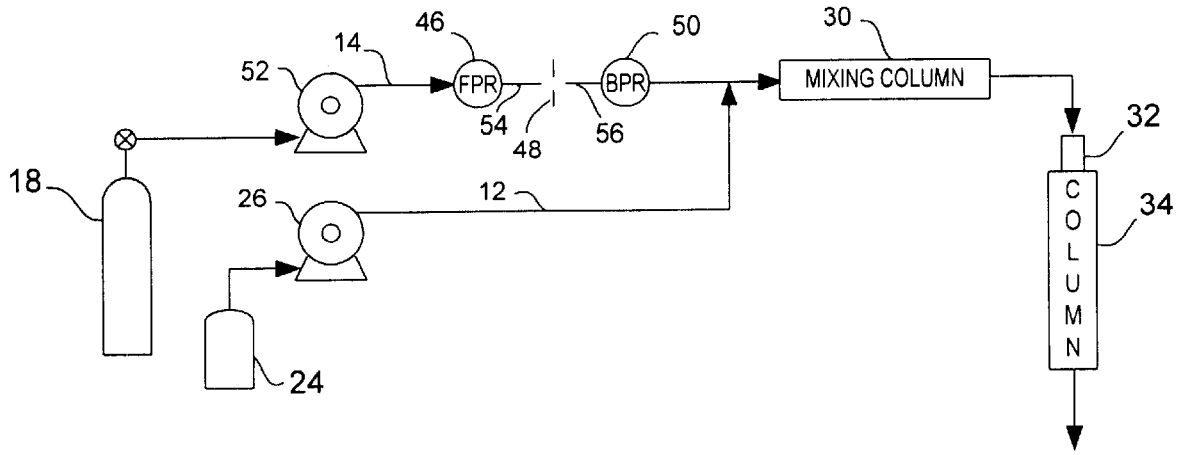
FIG. 2 is a schematic of a compressible fluid flow stream with the preferred embodiment.

FIG. 2 is a schematic of an SFC system with the device of the preferred exemplary embodiment installed on flow line 14, containing compressible supercritical fluid. After pump source 52, a forward pressure regulator (FPR) 46 is installed on flow line 14. After the FPR 46, a type of fixed restrictor 48 is followed by a back-pressure regulator (BPR) 50. The FPR 46 installed directly downstream of pump source 52 dampens out oscillation from noisy pressure signals caused by large ripples in the flow leaving pump source 52. This effect provides near-constant outlet pressure from pump source 52. Downstream of the FPR is tubing 54 connected on opposite sides of a fixed restrictor 48. In the preferred embodiment, the fixed restrictor 48 is a precision orifice. The orifice can be any precision orifice, such as a jewel having a laser-drilled hole or precision tubing.

Any types of FPRs and BPRs capable of use in SFC systems may be implemented for the present invention. Pressure regulators 46, 50 may be mechanically, electromechanically, or thermally controlled. Pressure regulators 46, 50 should have low dead volumes if peak collection is an important result. Some older generation pressure regulators 46, 50 have dead volumes as high as 5 ml and therefore should be avoided. Pressure regulators may also be heated to prevent the formation of solid particles of the mobile phase from forming.

The configuration of a precision orifice 48 between an FPR 46 and BPR 50 is designed to control the pressure drop $\Delta P$ across the orifice 48. Controlling $\Delta P$ will control the flow of compressible fluid in the system. The flow past the orifice 48 should remain as close to constant temperature as possible. Changing the size of the orifice 48 changes the flowrate range. The invention can operate with some drop in pressure if there is little temperature change. If there is a drop in $\Delta P$ in addition to cooling across orifice 48, the positive effects of flow control begin to degrade. The orifice is set to create a restriction which limits the mass flow rate. With fixed restrictors, SFC must achieve operating pressures by varying the flow rates. The size of the static orifice can be changed to create discrete pressure levels at flow rate that provide the same integrated mass of expanded mobile phase at each pressure setting.

The preferred embodiment operates most efficiently for small $\Delta P$ across the single orifice 48, sending flow from repeated injections of similar samples through a single column 34 while knowing the gradient of flow. To assist in maintaining the constant flow stream, the pressure source 52 pumps flow at a pressure higher than any pressure required throughout the system. For example, CO2 flow rates may range from 37.5 ml/minute to 25 ml/minute at pressures up to 400 bar. As one skilled in the art will understand, alternative embodiments of the invention can operate under conditions that can vary significantly from exemplary embodiments. For example, a variable orifice can change ΔP and the flow rate according to adjustments made by a control system.

According to the present invention, an SFC pump is converted from a flow source into using the pump as a pressure source while continuing to control the flow rate. The preferred embodiment allows for constant mass flow of compressible fluids and even provides for constant mass flow in the presence of rising outlet pressure. As the pump 52 sends mobile phase through the column and more fluid from both flow streams are pumped together, and pressure rises in the flow stream independent of the fact that less percentage of CO2 is being pumped. After the CO2 leaves the BPR 50, the pressure drops to an undefined value, which is in the column inlet pressure. The column inlet pressure has no effect on flow control of the present invention unless the column pressure becomes too high through a system malfunction or inadvertent operator mistake. Pump 52 is also operated at a pressure higher than any downstream pressure requirements. With these operating conditions, the described system is useful in a system built for analytical or semi-preparatory to preparatory supercritical fluid chromatography but may also be used in HPLC or supercritical fluid extraction systems.

By utilizing the series of pressure regulators 46, 50 with a precision orifice 48 placed after a pressure source 52 in the compressible fluid flow stream 14, a high cost SFC-grade pump can be replaced with an inexpensive, lower-grade pump. An example of a replacement for pump 22 is a piston-drive pneumatic pump 52. An air driven pump can be modified for use in an SFC system to deliver compressible fluids at extremely high pressures, such as 10,000 psi. A pneumatic pump is not typically used in SFC systems because of significant problems with imprecise flow and pressure parameters, such as pressure ripples producing noisy pressure signals. The present invention provides precise flow by dampening out a noisy pressure signal and uneven flow so that a pneumatic pump functions as well as an SFC-grade reciprocating pump.

Figure 3:
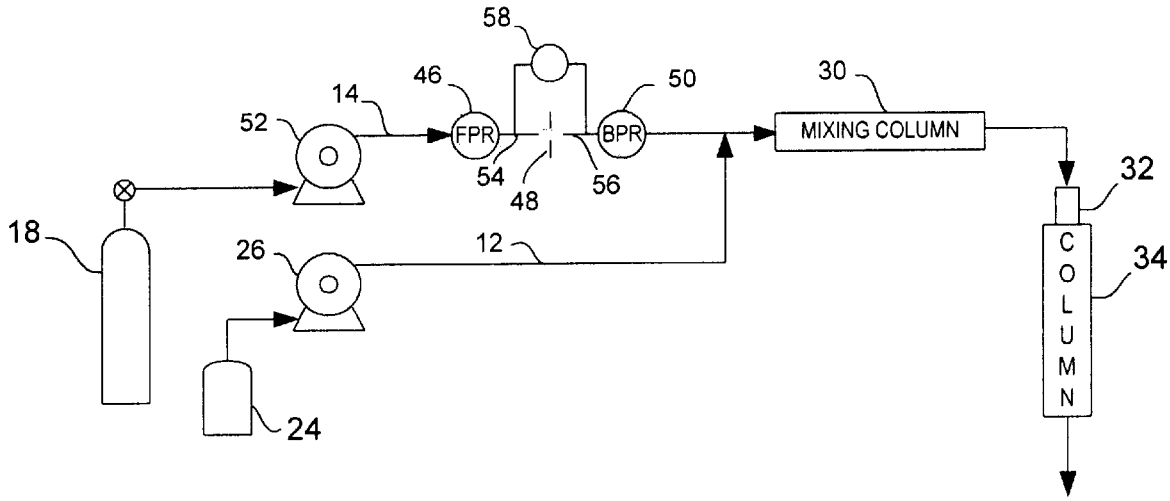
FIG. 3 is a schematic of a compressible fluid flow stream with an alternative embodiment.

An alternative embodiment to the present invention is illustrated in FIG. 3. The schematic of an SFC system shows a source of compressible fluid 18 feeding compressible fluid pump 52. Flow line 14 feeds an FPR 46, a fixed restrictor 48, following by a BPR 50. FPR 46 is installed directly downstream of pressure source 52 and dampens out oscillation from noisy pressure signals caused by large ripples in the flow leaving pump 52, thereby providing nearly constant outlet pressure. In the alternative embodiment, the fixed restrictor 48 is a precision orifice. The orifice can be any precision orifice, such as a jewel having a laser-drilled hole or precision tubing. A differential pressure transducer 58 can be installed on flow lines 54 and 56 around restrictive orifice 48 to control ΔP across the orifice 48. The differential transducer 58 is being used as a mass flow transducer and employs a servo control system for performing a servo algorithm to control the transducer 58 in accordance with the requirements of the present invention.

Figure 4:
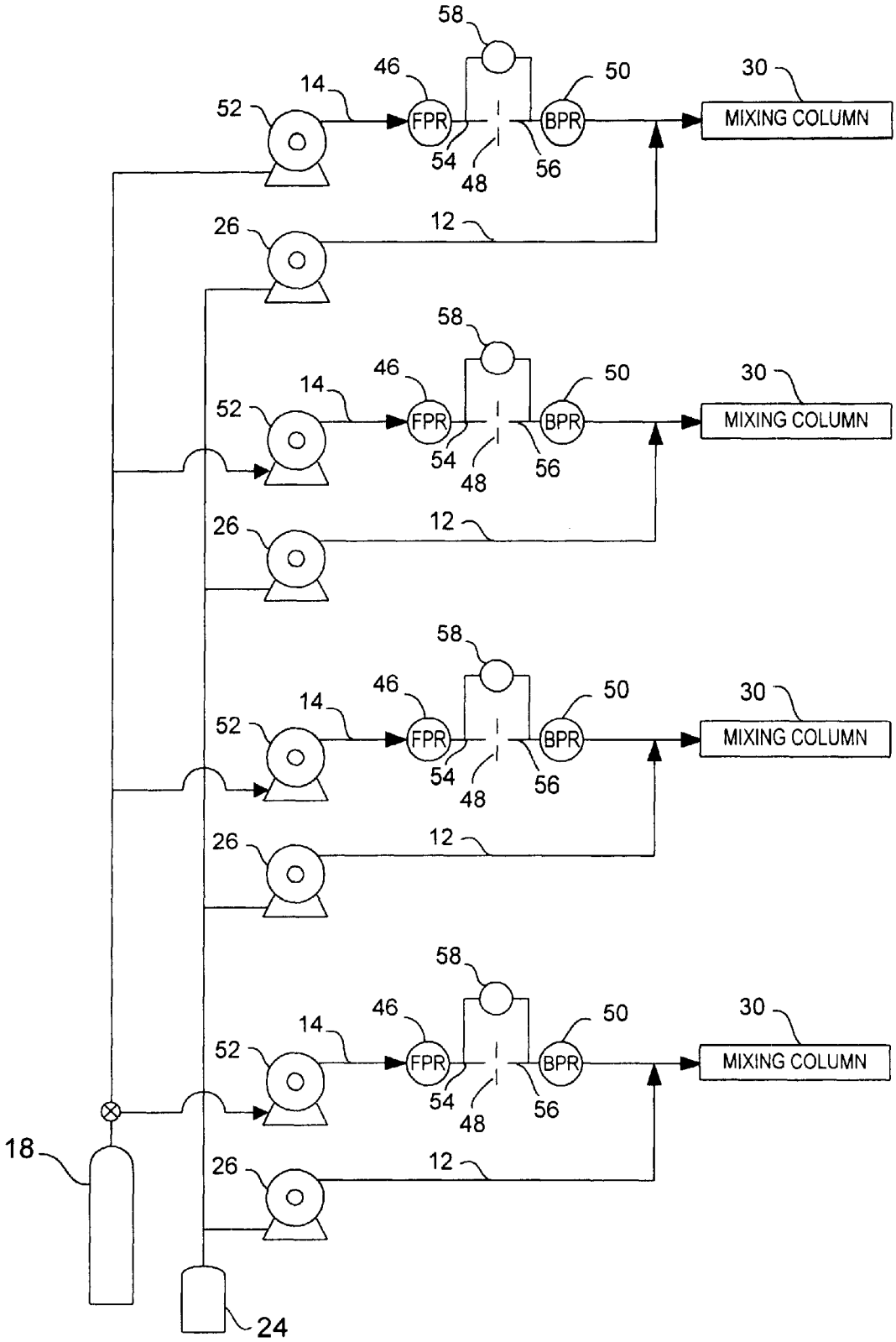
FIG. 4 is a schematic of a multiplexed compressible fluid flow stream using the invention in parallel with multiple pumps.

In an additional alternative embodiment, illustrated in FIG. 4, flow channels of compressible fluid flow streams are multiplexed in parallel, thereby creating significantly greater volumetric capacity in SFC systems. Pumps 52 may draw from a single source of compressible source fluid 18, such as CO2. Flow control is gained from pressure flow out of pumps 52 operating with duplicated series of a restrictive orifice 48 between FPR 46 and BPR 50, according to the present invention. The multiplexed system is illustrated having a differential transducer 58 installed around restrictive orifice 48, however as described in the preferred embodiment, flow control of a pressure source may be practiced without transducer 58. Higher cost SFC-grade pumps are replaced with low-grade, imprecise compressible fluid pumps 52, thereby providing a cost-effective plurality of channels of compressible flow streams.

FIG. 4 illustrates an individual modifier pump 26 fed by a common supply tank 24 for each modifier flow stream 12 that feeds into the compressible fluid flow stream prior to entering the mixing column 30 in each of the multiplexed pumping systems. An alternative embodiment to this design is to use a single modifier pump 26, such as a multi-piston pump, that has multiple flow outlets that can feed multiple channels. A multi-piston pump draws modifier from tank 24 and distributes flow to each modifier flow stream 12 from the single pump. In the exemplary embodiment in FIG. 4, a single four port multi-piston pump could substitute for the four modifier pumps 26 for the multiplexed system.

Figure 5:
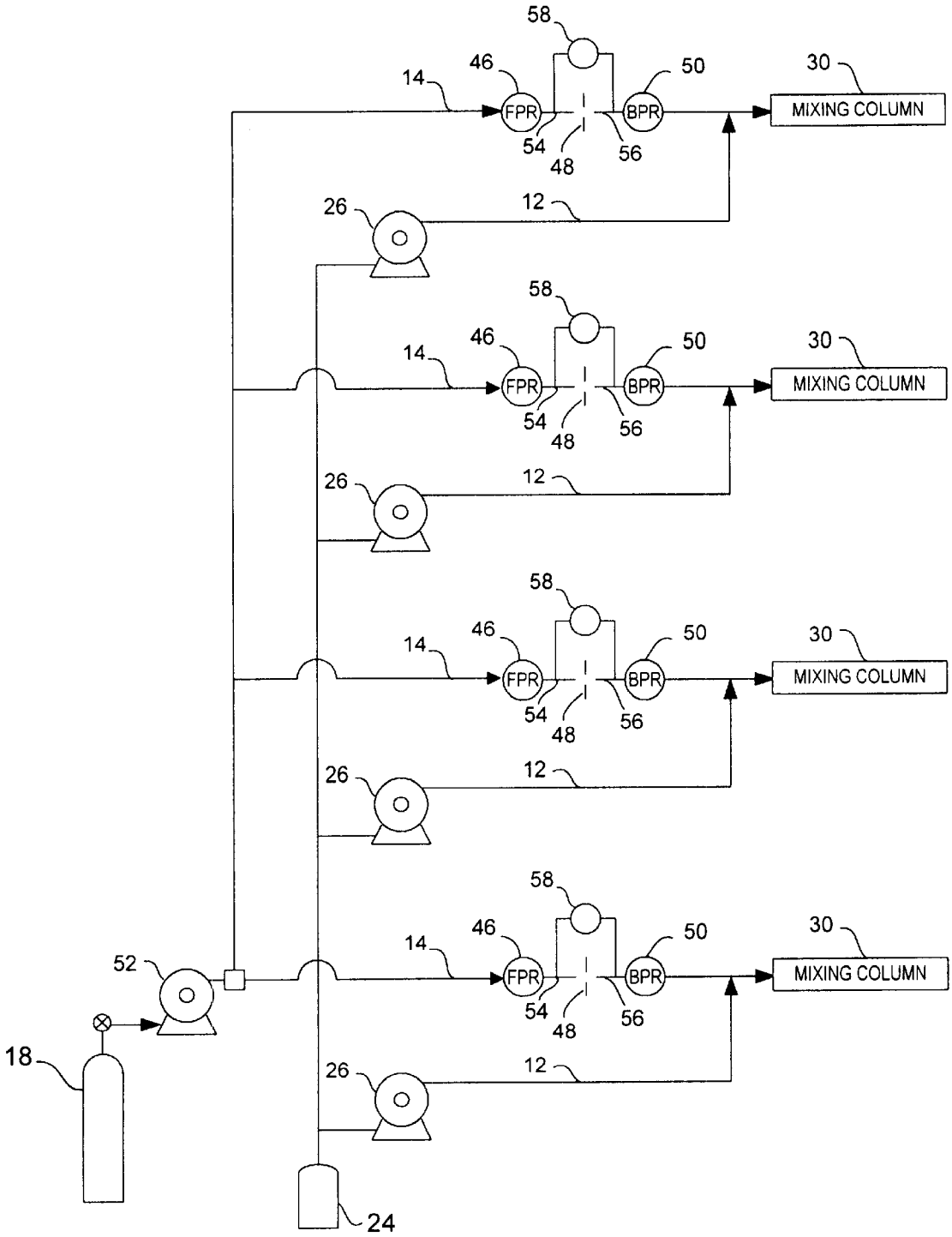
FIG. 5 is a schematic of a multiplexed compressible fluid flow stream using the invention in parallel with a single pump.

In an additional exemplary embodiment, illustrated in FIG. 5, the compressible fluid flow stream of an SFC system is multiplexed in parallel from single pump 52. For this application, outlet pressure of pump 52 is kept much higher than pressure used in a single flow channel. Flow is distributed to each parallel channel through any pressure distribution control device compatible with the compressible source fluid and the high-pressures necessary for SFC systems. Flow control is gained from pressure flow operating with duplicated series of a restrictive orifice 48 between FPR 46 and BPR 50 for each parallel channel. The multiplexed system is illustrated having a differential transducer 58 installed around restrictive orifice 48, however as described in the preferred embodiment, flow control of a pressure source may be practiced without transducer 58. A higher cost SFC-grade pump is replaced with low-grade, imprecise compressible fluid pump 52, thereby providing a cost-effective plurality of channels of compressible flow streams.

Figure 6:
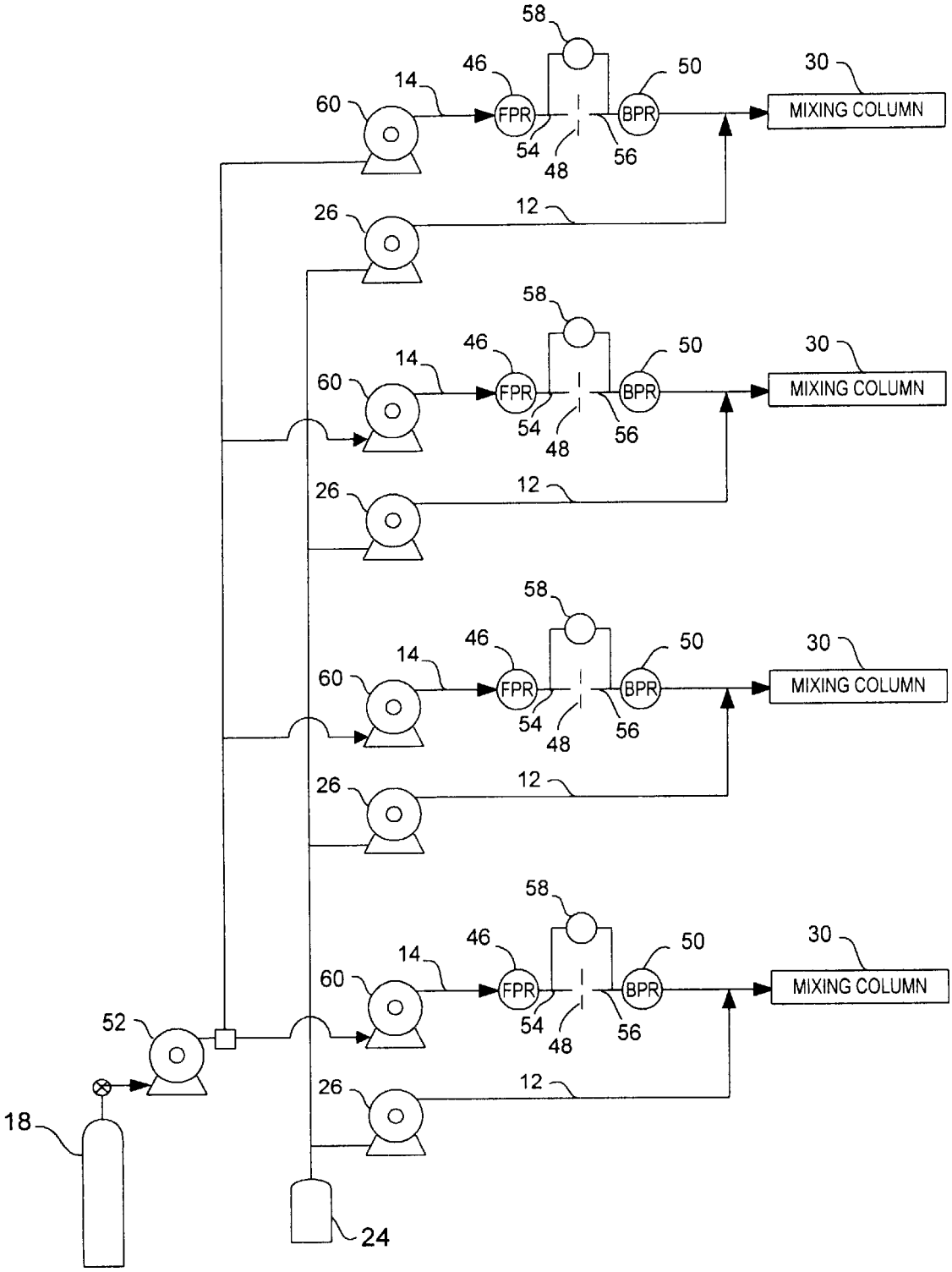
FIG. 6 is a schematic of a multiplexed compressible fluid flow stream using the invention in parallel with two pumps.

Reference is made to FIG. 6, illustrating another embodiment of the present invention. In this embodiment, compressible fluid flows to the restrictive orifice 48 from two pumps. The first is a compressible fluid pump 52 that is fed directly from the compressible fluid supply tank 18. This pump 52 raises flow pressure to a consistent level very near the critical point. For example, pressure is raised by pump 52 between 200 and 1200 psi in the first stage. Pump 52 is then followed by a second stage booster pump 60 for each channel on the compressible fluid flow stream. The booster pump 60 raises pressure in the individual flow lines leading to orifice 48. In an example, pressure in line 14 from pump 60 ranges from 1200 to 6000 psi.

The present invention is well suited for use in chromatography systems operating in the supercritical, or near supercritical, ranges of flow stream components. However, as one skilled in the art will recognize, the invention may be used in any system where it is necessary to obtain steady flow of liquid at high pressures with high degrees of accuracy of pressure and flow using an imprecise pressure source. Other applications may include supercritical fluid extraction systems or HPLC where separation and/or collection of sample contents into a high-pressure flow stream occurs.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed:

1. A system for using a pump as pressure source in a flow stream containing a highly compressed gas, compressible liquid, or supercritical fluid, comprising:

a restrictor for restricting flow downstream of the pump;

a forward pressure regulator located upstream of the restrictor for controlling the outlet pressure from the pump; and a back-pressure regulator located downstream of the restrictor, where the back-pressure and forward-pressure regulators control the pressure drop across the restrictor.

2. The system of claim 1, wherein the restrictor is a precision orifice.

3. The system of claim 1, further comprising:

a temperature controller to control temperature across the restrictor such that the temperature remains as constant as practicable.

4. The system of claim 1, further comprising:

a differential pressure transducer to control pressure drops across the restrictor.

5. The system of claim 1, further comprising:

a plurality of channels of the flow streams in parallel where pressure is controlled in each channel with separate groups of the forward-pressure regulator, the restrictor, and the back-pressure regulator in each of the channels.

6. The system of claim 1, further comprising:

a plurality of channels of the flow streams in parallel where pressure is controlled in each channel with separate groups of the pump, the forward-pressure regulator, the restrictor, and the back-pressure regulator for each of the channels.

7. The system of claim 6, further comprising:

feeding each separate pump in each of the channels from a single source pump.

8. The system of claim 5, further comprising:

a single multi-piston pump for combining second flow streams of a relatively incompressible fluid into each of the channels.

9. An system for using a pump as pressure source in a flow stream containing a highly compressed gas, compressible liquid, or supercritical fluid, comprising:

an orifice in the flow stream located downstream from the pump;

a first pressure regulators located upstream of the orifice; and a second pressure regulator located downstream of the orifice, where the pressure regulators control the pressure drop across the orifice.

10. The system of claim 9, wherein:

the first pressure regulator is a forward pressure regulator.

11. The system of claim 9, wherein:

the second pressure regulator is back-pressure regulator.

* * * * *